US005369334A

United States Patent [19]

Goelling et al.

[11] Patent Number: 5,369,334

[45] Date of Patent: Nov. 29, 1994

[54] HIGH-PRESSURE DISCHARGE LAMP WITH OPTIMIZED DISCHARGE VESSEL

[75] Inventors: Hans-Werner Goelling; Clemens Barthelmes, both of Berlin, Germany

[73] Assignee: Patent-Treuhand-Gesellschaft F. Flektrische Gluehlampen MBH, Munich, Germany

[21] Appl. No.: 909,792

[22] Filed: Jul. 7, 1992

[30] Foreign Application Priority Data

Jul. 19, 1991 [DE] Germany ..... 4124055

[51] Int. Cl.[5] ..... H01J 17/16; H01J 61/30

[52] U.S. Cl. ..... 313/634; 313/571; 313/573; 313/642

[58] Field of Search ..... 313/634, 571, 573, 639, 313/643, 642

[56] References Cited

U.S. PATENT DOCUMENTS 3,382,396 5/1968 Holmes et al. ..... 313/571 X
3,621,322 11/1971 Rehmet et al. ..... 313/571
4,968,916 11/1990 Davenport et al. ..... 313/571
5,028,843 7/1991 Narita ..... 313/639 X

*Primary Examiner*—Donald J. Yusko
*Assistant Examiner*—Ashok Patel
*Attorney, Agent, or Firm*—Frishauf, Holtz, Goodman & Woodward

[57] ABSTRACT

To optimize operating conditions with respect to overall size of a high-pressure discharge lamp having a metal halide fill, the wall thickness (d) in millimeters is selected in accordance with a theoretical optimum relationship of $d=1.5+0.1\times\sqrt[3]{P}$, in which P is the power rating of the lamp, in watts. The optimal theoretical thickness should not vary by more than $\Delta d=\pm 0.2\times d$, in millimeters, from the theoretical optimal value, with lower power ratings permitting a thinner wall thickness than higher power ratings. Optimizing the wall thickness improves the color rendition index and the light distribution of the emitted light, as well as decreasing the devitrification of the quartz glass of the discharge vessel.

2 Claims, 2 Drawing Sheets

HIGH-PRESSURE DISCHARGE LAMP WITH OPTIMIZED DISCHARGE VESSEL

FIELD OF THE INVENTION

The present invention relates to high-pressure discharge lamps, and more particularly to high-pressure discharge lamps having a quartz glass discharge vessel which is formed essentially as a rotation-symmetrical body. Lamp shafts, located in the axis of rotation of the body, extend therefrom. The lamp shafts, likewise, are of quartz glass and retain discharge electrodes, melt-sealed therein and connected via connecting elements, such as foils, to external current terminals. A fill which includes at least one noble gas, mercury, and optionally one or more metal halides, is retained within the discharge vessel.

BACKGROUND

High-pressure discharge vessels with metal halide fill are subjected, in operation, to high pressures within the vessel. The wall thickness—entirely independently of the type of quartz glass used—always was a multiple of that required to withstand the given pressure within the vessel, in order to ensure that adequate safety factors were present. The result was that the external dimensions of the lamp were substantially higher than actually required by the operating conditions for the lamp if the discharge vessel volume is selected to be an optimum, considering the design requirements of the lamp, that is, for example the fill, the electrodes, and the like. Small external diameters, however, required for example for reasons of incorporation or association with optical apparatus such as reflectors or lenses, resulted in insufficient internal volume, or operation of the lamp with a discharge vessel volume which was less than an optimum. Devitrification could result.

THE INVENTION.

It is an object to provide a high-pressure discharge lamp, preferably having a metal halide and mercury fill, in which the wall thickness is appropriately matched to the power rating of the high-pressure discharge lamp, to result in a lamp which has more compact outer dimensions than heretofore and ensures optimal operating conditions for the lamp, coupled with sufficient mechanical stability and resistance against bursting.

Briefly, the wall thickness of the quartz glass discharge vessel is selected in accordance with the following formula:

$$d=1.5+0.1\times\sqrt[3]{P},$$

wherein d is the theoretically optimal wall thickness in millimeters, and

P is the power rating of the lamp in watts.

The optimal theoretical thickness, given in the foregoing equation, may vary by about ±0.3 d, preferably by not more than ±0.2 d, in dependence on the power rating of the lamp, in which a smaller value of d is desirable for lower power lamps, and a greater thickness is desirable for higher power lamps.

The lamps, typically, have power ratings between about 575 W to 12,000 W and over.

DRAWINGS

FIG. 1 is a highly schematic cross-sectional view through a high-pressure discharge lamp in accordance with the present invention; and FIG. 2 is a graph showing the relationship of optimal theoretical wall thickness d of the discharge vessel, as well as variations Δd with respect to power rating in KW P (abscissa) of the lamp.

DETAILED DESCRIPTION

Figure 1:
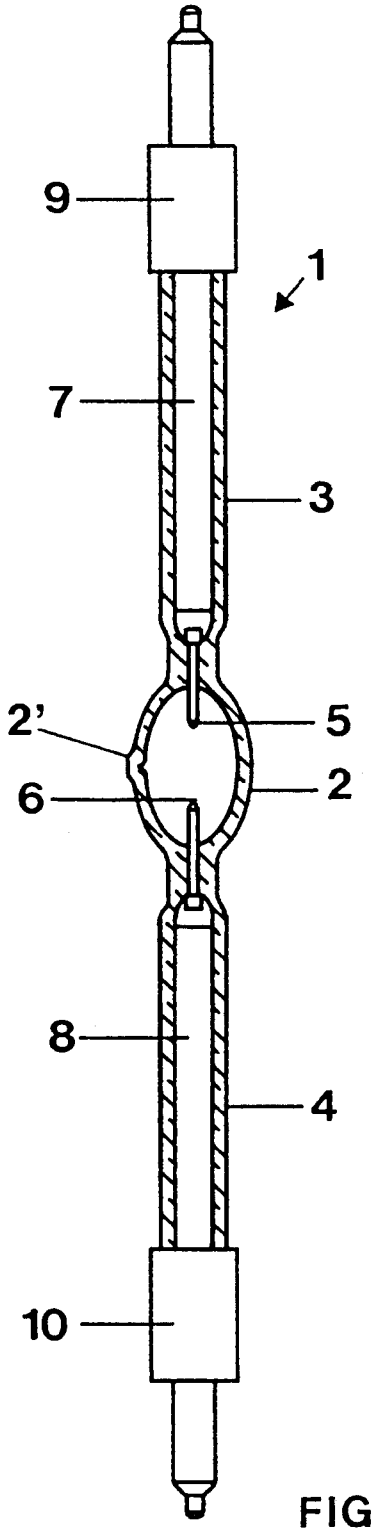

FIG. 1 shows a high pressure discharge lamp 1 having a metal halide fill with a power rating of 2500 W. The discharge vessel 2 is made of quartz glass, and has a generally ellipsoid shape. The axis of rotation of the rotation-symmetrical ellipsoidal discharge vessel 2 extends in FIG. 1 in a vertical direction. The discharge vessel 2 has a pump or exhaust tip 2'. Lamp shafts 3, 4 of quartz glass are joined to the vessel 2, extending along the axis of rotation. The lamp shafts 3, 4 extend from the two diametrical opposite ends and, each, retain a pin electrode 5 of tungsten, melt-sealed into the vessel and the neck 3, 4, respectively. The tungsten pin electrode 5, 6 is connected to a molybdenum sealing foil 7, 8, melt-sealed in the respective lamp shafts 3, 4. The sealing foils 7, 8, in turn, are connected to lamp bases which, in the example shown, are of the type SFa 21-12, and electrically connected thereto. The base sleeves 9, 10 of the bases are seated on the free ends of the respective lamp shafts 3, 4 and secured thereto by a suitable cement.

In accordance with a feature of the invention, the discharge vessel 2 has an optimum wall thickness of 2.5 mm, which is derived from the relationship $$d(mm)=1.5+0.1\times\sqrt[3]{P} \quad (1)$$

and in which the dimension d may vary by about ±0.3×d.

Investigations of metal-halide high-pressure discharge lamps of different power ratings have shown that the theoretically best wall thickness can be determined by making the dimension d, wall thickness, in accordance with the above-identified relationship, in which P is the power rating of the lamp in watts. This thickness, so determined, is substantially thinner than that previously used in the prior art. Consequently, with similar outer dimensions, the spacing between the discharge arc and the quartz glass will be greater. This greater spacing results in an improved color rendition index Ra, particularly and further in an improved color rendition index $R_9$ for the red wave length region. It also results in cooler operation of the lamp, since the temperature at the inner wall surface of the bulb will be reduced. This reduced temperature decreases devitrification of the quartz glass, and extends the lifetime of the lamp.

The theoretical optimal value for the wall thickness may be changed by varying the theoretical thickness d by a variation Δd of ±0.2×d, without substantially deteriorating the operation conditions of the lamp or changing the operating conditions from the theoretically optimal conditions. If higher mechanical strength or stability is required, the wall thickness can be moved closer to the upper limiting value defined by Δd above the theoretical optimum value; high-pressure discharge lamps of lower power rating may use quartz glass with a wall thickness closer to the lower limiting value, since the mechanical strength is of less importance. For lower wattage rated high-pressure discharge lamps, the external dimensions can be made even more compact.

The thinner quartz glass of the discharge vessel, while providing excellent assurance against bursting, has the additional advantage of resulting in a more uniform light intensity distribution, since distortions by the wall of the quartz glass vessel, particularly within the region of the exhaust tip 2' are effectively prevented.

Figure 2:
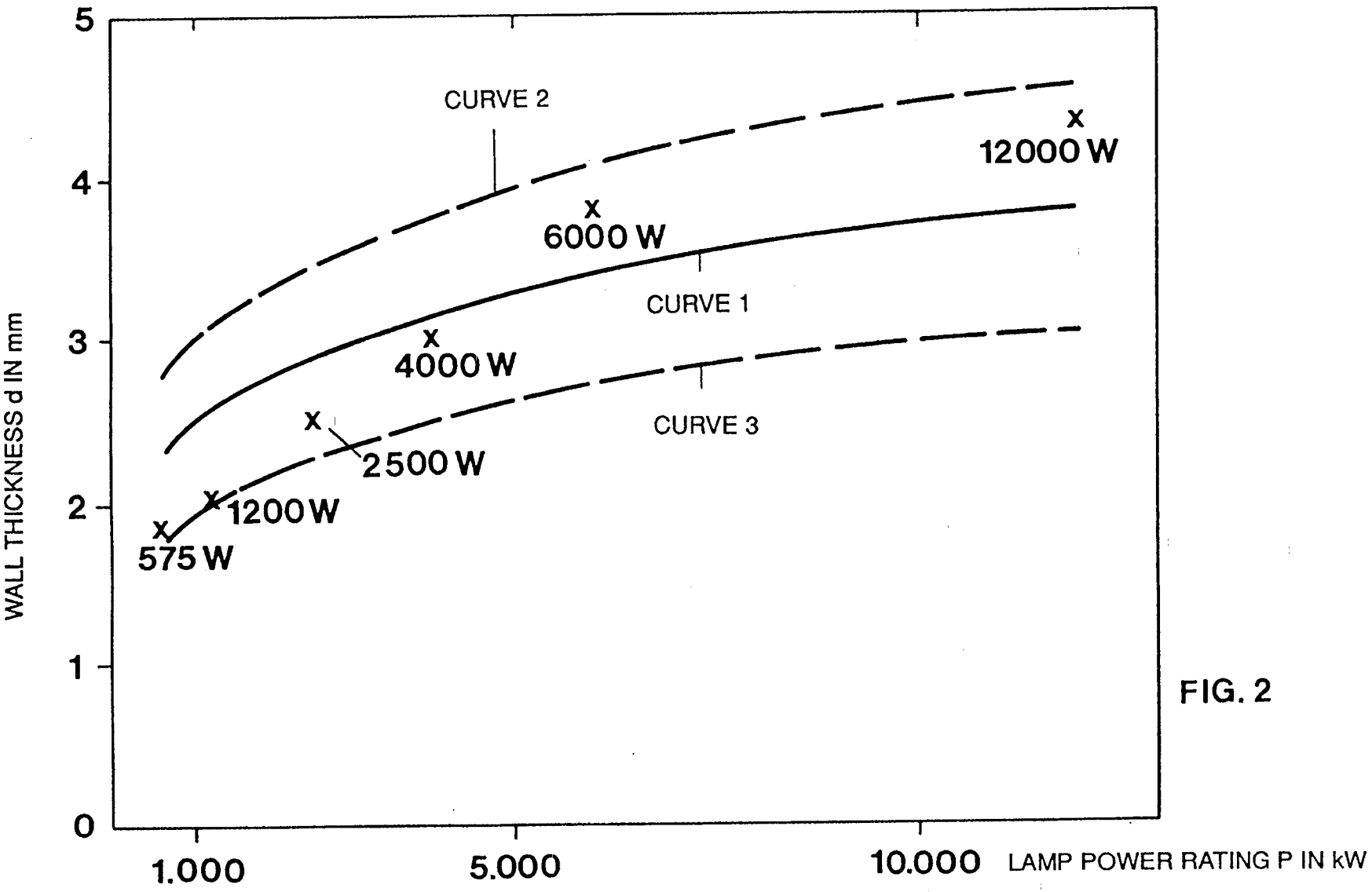

FIG. 2 illustrates the relationship of wall thickness with respect to power, given by the relationship (1) in the solid-line curve 1. Symmetrically thereto, and shown by broken-line curves 2 and 3, the variation of $\Delta d = \pm 0.2 \times d$ defines a range between which the wall thicknesses of the high-pressure discharge lamps of the present invention should be placed. The actual values selected for high-pressure discharge lamps which provide for optimum operating conditions with minimum light distortion, devitrification, yet providing high safety, for respective power ratings, are shown by x marks in the drawing. The table below shows actually used wall thicknesses in metal halide high-pressure discharge lamps in power ratings of between 575 to 12000 W, as well as the calculated deviation $\Delta d = 0.2 \times d$ from the theoretically optimum calculated values.

| Rated power (W) | Wall thickness of discharge vessel (mm) calculated | actually used |
|---|---|---|
| 575 W | 2.3 ± 0.5 | 1.8 |
| 1200 W | 2.6 ± 0.5 | 2.0 |
| 2500 W | 2.9 ± 0.6 | 2.5 |
| 4000 W | 3.1 ± 0.6 | 3.0 |
| 6000 W | 3.3 ± 0.7 | 3.8 |
| 12000 W | 3.8 ± 0.8 | 4.3 |

The upper and lower limits referred to in the specification are for general guidance to safe and best quality lamps which could be exceeded for lower quality products.

The drawing in FIG. 1 illustrates a double-ended lamp, but for even lower powered, single-ended lamps, the above relationship is also suitable with the wall thickness going below the preferred lower limit of d.

We claim:

1. A high-pressure discharge lamp (1) having an essentially rotation-symmetrical discharge vessel (2) of quartz glass;

a lamp shaft (3, 4) of quartz glass extending from the discharge vessel in the direction of the axis of rotation of said rotation-symmetrical discharge vessel;

electrodes (5, 6) melt-sealed into the lamp shaft, and electric connection means (7, 8, 9, 10) electrically connected to said electrodes; and a fill of at least one noble gas, mercury, and optional at least one metal halide within the discharge vessel, wherein, in accordance with the invention, the wall thickness of the discharge vessel (2) is selected in accordance with optimized parameters comprising bursting strength, interior volume of the discharge vessel, light transmissivity of the discharge vessel, color rendition index and resistance against devitrification of the quartz glass of the discharge vessel, and dimensioned to have a theoretical optimum wall thickness d in millimeters of $$d = 1.5 + 0.1 \times \sqrt[3]{P}$$

wherein the wall thickness d may vary by a value of $\Delta d$ of $\pm 0.3 \times d$, in millimeters, and wherein P is the power rating of the lamp, in watts.

2. The lamp of claim 1, wherein the variation $\Delta d$ in wall thickness, in millimeters, deviates from the theoretical optimal wall thickness by $\pm 0.2 \times d$.

* * * * *